United States Patent [19]

Boyer et al.

[11] Patent Number: 4,468,564

[45] Date of Patent: Aug. 28, 1984

[54] ION SOURCE

[75] Inventors: Robert Boyer, Pierrelatte; Jean-Pierre Journoux, Piolenc, both of France

[73] Assignee: Commissariat a l'Energie Atomique, France

[21] Appl. No.: 434,834

[22] Filed: Oct. 18, 1982

[30] Foreign Application Priority Data

Oct. 21, 1981 [FR] France ..... 81 19761

[51] Int. Cl.[3] ..... H01J 27/00

[52] U.S. Cl. ..... 250/427; 250/423 R; 313/359.1

[58] Field of Search ..... 250/423, 427, 356; 313/359, 361, 363; 315/111.81

[56] References Cited

U.S. PATENT DOCUMENTS 2,967,943 1/1961 Gow ..... 250/427
3,293,491 12/1966 Hanson ..... 315/111.81
3,611,029 10/1971 Stix ..... 317/4
4,045,677 8/1977 Humphries ..... 250/423 R
4,126,806 11/1978 Kapetanakos et al. ..... 313/359.1
4,282,436 8/1981 Kapetanakos et al. ..... 250/423 R

*Primary Examiner*—Bruce C. Anderson
*Attorney, Agent, or Firm*—James E. Nilles

[57] ABSTRACT

The invention relates to an ion source.

This source comprises a gas ionization chamber, an electron source and means for oscillating the electrons in the chamber, so as to produce an ionization zone of the gas. The means for oscillating the electrons comprise two identical electron lenses, whose axes coincide with the oscillation direction, two spherical concave mirrors turned towards one another and positioned respectively on either side of the two lenses and whose centers respectively coincide with the foci of the lenses, the electron source being positioned at the focus of one of the two lenses.

Application to the analysis of gases by mass spectrometry.

4 Claims, 3 Drawing Figures

ION SOURCE

BACKGROUND OF THE INVENTION

The present invention relates to an ion source, which can be used, for example, in the analysis of gases of mass spectrometry.

An ion source of a first type is known, which comprises an ionization chamber, an electron source constituted by a heating filament (cathode) and a trap (anode) facing it.

The electrons emitted are accelerated between the filament and the ionization chamber and ionize the molecules of the gas contained in the chamber. A servo system may optionally permit, as a result of the electron current collected on the anode, the regulation of the current circulating in the filament, so that it can stabilize the electron flux emitted towards the ionization zone.

A magnetic field in the direction of the electron beam channels the electrons and permits a better extraction of the ions produced towards an analyzer, such as e.g. a mass spectrometer.

In this type of source, each electron emitted only traverses the ionization chamber once when it does not ionize a molecule. This leads to a low ionization efficiency between $10^{-4}$ and $10^{-6}$. This efficiency is defined by the ratio of the number of ions formed to the number of electrons emitted.

Another coefficient characterizing the performances of an ion source is defined by the ratio of the number of ions formed to the number of molecules introduced, said coefficient being called "luminosity". The luminosity of the aforementioned sources is very low.($-10^{-5}$).

Ion sources of a second type are known, whose ionization efficiency and luminosity are higher than those of the aforementioned sources. These sources comprise a filament, which produces electrons, an accelerating cathode and an anode collecting the electron current. An intermediate electrode is positioned between the cathode and anode and an anticathode is positioned behind the anode. Voltage pulses are applied to the cathode, so as to bring about a discharge between the cathode and the intermediate electrode and this discharge ionizes the gas. The electrons produced then oscillate in the zone between the intermediate electrode and the anticathode, in which a potential trough is produced. The electrons produce an ionization of the gas in said zone. This source has a better efficiency of luminosity than the aforementioned source, but its construction is complicated and it is very difficult to realize.

BRIEF SUMMARY OF THE INVENTION

The problem of the present invention is to obviate the disadvantages of the known sources and in particular to provide an ion source in which the electrons oscillate, which has a less complicated construction and realization, together with a higher efficiency and luminosity than the second type of source referred to hereinbefore.

The present invention specifically relates to an ion source comprising a gas ionization chamber and in said chamber at least one electron source, means for oscillating the electrons from the source in a predetermined direction, so as to produce an ionization zone of the gas, and means for collecting the ions produced, wherein the means for oscillating the electrons comprise two identical facing electron lenses, whose axes coincide with the predetermined direction, two concave spherical mirrors turned towards one another and positioned respectively on either side of the two lenses in such a way that their centres respectively coincide with the foci of the lenses, the electron source being located at the focus of one of the two lenses.

According to another feature of the invention each lens is constructed in such a way as to accelerate the electrons reflected by the mirror corresponding thereto and to decelerate the electrons coming from the other lens, whereby the lens whose focus constitutes the location of the source is able to accelerate the electrons emitted by said source.

According to another feature, the ion source comprises another electron source located at the focus of the other of the two lenses.

According to another feature, the lenses are raised to identical electrical potentials.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
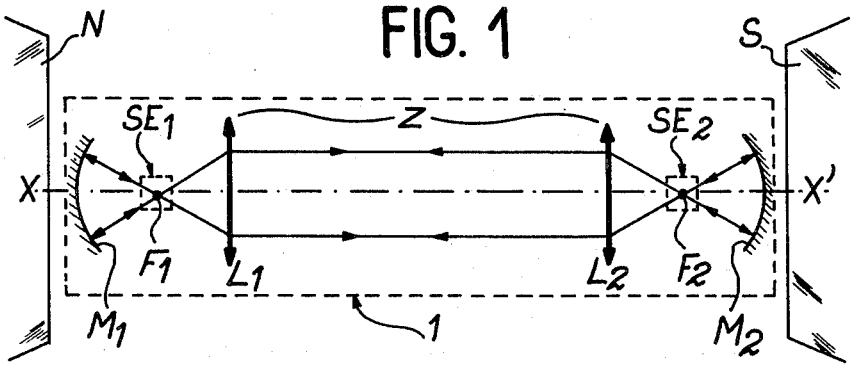
FIG. 1 is a diagrammatic view permitting a better understanding by analogy and with an optical system, the structure and operation of the source according to the invention.

FIG. 1 very diagrammatically illustrates the ion source according to the invention. This source comprises an ionization chamber 1, which is shown in a diagrammatic manner and, in the said chamber, at least one electron source $SE_1$ and means for oscillating the electrons from the source in a predetermined direction XX', so as to create an ionization zone Z of the gas contained in chamber 1. These means comprise two facing, identical electron lenses $L_1$, $L_2$, whose axes coincide with the predetermined direction X'X. These means also comprise two concave, spherical mirrors $M_1$, $M_2$, which are turned towards one another and located respectively on either side of the two lenses $L_1$, $L_2$. The centres of these mirrors respectively coincide with the foci $F_1$, $F_2$ of the lenses. Electron source $SE_1$ is, for example, located at focus $F_1$ of lens $L_1$. As will be shown hereinafter, each lens is constructed so as to accelerate the electrons reflected by the mirror corresponding thereto and so as to decelerate the electrons coming from the other lens. Thus, for example, lens $L_2$ makes it possible to decelerate the electrons coming from lens $L_1$ and to accelerate the electrons reflected by mirror $L_2$, while lens $L_1$ decelerates the electrons from lens $L_2$ and accelerates the electrons emitted by source $SE_1$ or the electrons reflected by mirror $M_1$. Another electron source $SE_2$, identical to source $SE_1$, may optionally be located at focus $F_2$ of lens $L_2$, so as to supply electrons, particulrly in the case of a breakdown of source $SE_1$. As will be shown hereinafter, lenses $L_1$ and $L_2$ are raised to identical electrical potentials. The drawing also shows magnetic pole pieces N and S, which optionally permit a better focusing of the electrons circulating in the ionization chamber, but they are not indispensable. Thus, the focusing of the electrons can be adequately ensured by lenses $D_{11}$, $D_{21}$, $D_{31}$, $D_{12}$, $D_{22}$, $D_{32}$.

Figure 2:
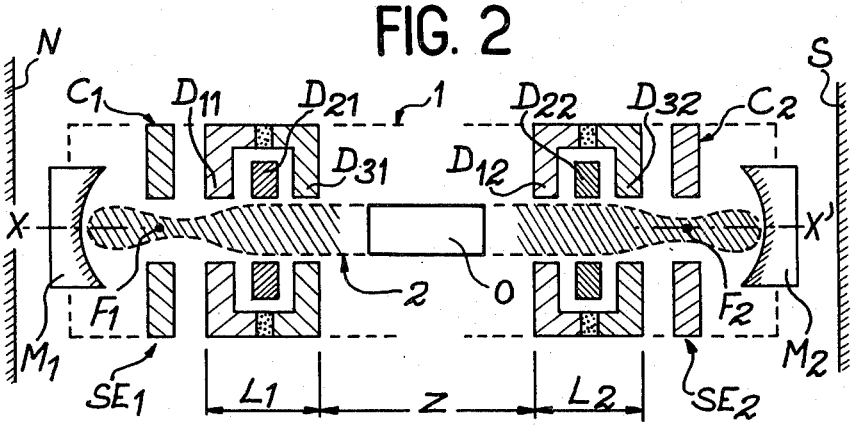
FIG. 2 is a more detailed view of the ion source according to the invention.

FIG. 2 shows in greater detail, an ion source according to the invention. The same elements carry the same references as in FIG. 1. It is assumed that all the elements shown in FIG. 2 are cylindrical and are viewed in section, the openings in these elements being rectangular. The device shown in greater detail here comprises lenses $L_1$ and $L_2$, mirrors $M_1$, $M_2$, electron sources $SE_1$ and $SE_2$ and magnetic pole pieces N and S. The ionization chamber 1 is shown diagrammatically in broken line form. Electron source $SE_1$ can, for example, be constituted by an undefined heating filament, located at focus $F_1$ of lens $L_1$ and surrounded by an electrode $C_1$ (Wehnelt cylinder). Lens $L_1$ can be constituted by diaphragms $D_{11}$, $D_{21}$, $D_{31}$. In the same way, lens $L_2$ can be constituted by diaphragms $D_{12}$, $D_{22}$, $D_{32}$. FIG. 2 also shows the second electron source $SE_2$, which is formed by an undefined filament located at focus $F_2$ of lens $L_2$ and by an electrode $C_2$ surrounding the said filament. For example, the filament, the electrode or electrodes $C_1$ or $C_2$ and the mirrors $M_1$, $M_2$ are raised to the potential of the filament, which is close to 0 volt. Diaphragms $D_{11}$ and $D_{32}$ are raised to a potential close to 280 volts, while diaphragm $D_{31}$ and $D_{32}$, which are electrically insulated from the aforementioned diaphragms, as well as ionization chamber 1, are raised to a potential close to 190 volts. Diaphragms $D_{21}$ and $D_{22}$ are raised to a negative potential close to $-10$ volts. The configuration of the beam of oscillating electrons is shown at 2 in the drawing. The ionization zone is the area between the diaphragms $D_{31}$ and $D_{12}$. The ions are extracted as a result of the magnetic field, using a slit 0 located halfway between lenses $L_1$, $L_2$ and perpendicular to the plane of the drawing.

Figure 3:
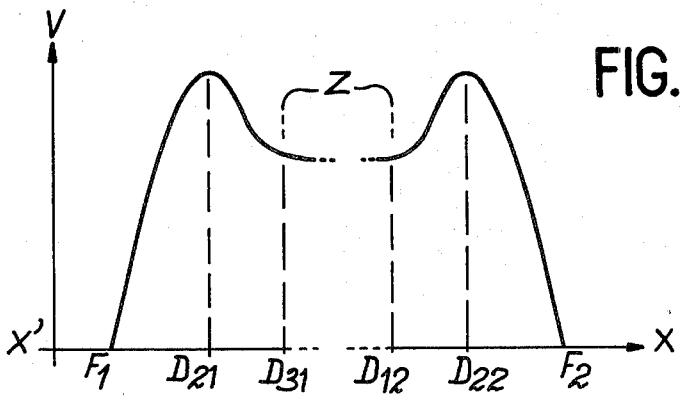
FIG. 3 is the distribution of the potentials along axis X'X of the ionization chamber.

FIG. 3 shows the distribution of the potential V of the long axis XX' of the ionization chamber. The potential is constant in the ionization zone Z between diaphragms $D_{31}$ and $D_{12}$. This potential is zero in the vicinity of the filament located at focus $F_1$ and then it rises to reach a maximum in the vicinity of diaphragm $D_{21}$ and finally decreases in the vicinity of diaphragm $D_{31}$. It then stabilizes at a constant value in the ionization zone Z between diaphragms $D_{31}$ and $D_{12}$. The potential then increases again between diaphragm $D_{12}$ and $D_{22}$ to reach a zero value in the vicinity of the filament located at focus $F_2$ of lens $L_2$. In the zone, there is an accumulation of electrons in groups for each oscillation and this leads to an intense ionization in this zone.

As a result of the device described hereinbefore, each electron can perform up to 25,000 oscillations. The life of an electron produced by the source according to the invention is approximately 50,000 times longer than the life of an electron produced by known sources. Thus, the source according to the invention makes it possible, by increasing the range of the electron and its life (due to the oscillations) to obtain an efficiency and luminosity well above those of the known devices, because the number of ions formed can be much greater. In addition, the number of gaseous molecules which can be introduced into the ionization chamber can be as high as for the known sources. Thus, in the source described hereinbefore, any electron from the filament located at focus $F_1$ of lens $L_1$ is focused at focus $F_2$ of lens $L_2$ and then moves off in the opposite direction after having been reflected by mirror $M_2$. The electron which then fomes from lens $L_2$ finds identical conditions with lens $L_1$ and mirror $M_1$.

The source described hereinbefore has numerous advantages compared with existing sources. Thus, the luminosity is multiplied by 20, the ionization efficiency is multiplied by 200, the temperature of the chamber is considerably reduced, because it passes from 80° to 40° C. (because it is not necessary to produce as many electrons as with existing devices for ionizing the same number of gaseous molecules). The actual filament temperature can be lowered by 500° C. because, for the same efficiency, the number of electrons emitted by the filament is lower, while the electric power supplied thereto is twice as low. The electron emission current is divided by ten, while the average life of the filament increases from 5,000 hours to $2 \cdot 10^9$ hours. The much better performances compared with the known sources and particularly the increase in the luminosity, make it possible to supply much more intense ion currents to the mass spectrometers, so that the signal-to-noise ratio is increased. This luminosity increase makes it possible, for ion currents equivalent to those of known sources, to use gases having much lower pressures, so that the life of the sources can be increased. The symmetry of the device makes it possible to reverse the electron emitting source.

What is claimed is:

1. An ion source comprising a gas ionization chamber and in said chamber at least one electron source, means for oscillating the electrons from the source in a predetermined direction, so as to produce an ionization zone of the gas, and means for collecting the ions produced, wherein the means for oscillating the electrons comprise two identical facing electron lenses, whose axes coincide with the predetermined direction, two concave spherical mirrors turned towards one another and positioned respectively on either side of the two lenses in such a way that their centres respectively coincide with the foci of the lenses, the electron source being located at the focus of one of the two lenses.

2. An ion source according to claim 1, wherein each lens is constructed in such a way as to accelerate the electrons reflected by the mirror corresponding thereto and to decelerate the electrons coming from the other lens, whereby the lens whose focus constitutes the location of the source is able to accelerate the electrons emitted by said source.

3. An ion source according to claim 1, wherein it comprises another electron source located at the focus of the other of the two lenses.

4. An ion source according to claim 2, wherein the lenses are raised to identical electrical potentials.

* * * * *